US011692680B1

(12) United States Patent
Yang et al.

(10) Patent No.: US 11,692,680 B1
(45) Date of Patent: Jul. 4, 2023

(54) PROJECTION LAMP AND LAMP HOLDER

(71) Applicant: SHENZHEN XIANZHUO TECHNOLOGY CO., LTD, Shenzhen (CN)

(72) Inventors: Bofeng Yang, Shenzhen (CN); Xianqi Lu, Huizhou (CN)

(73) Assignee: SHENZHEN XIANZHUO TECHNOLOGY CO., LTD, Shenzhen (CN)

( * ) Notice: Subject to any disclaimer, the term of this patent is extended or adjusted under 35 U.S.C. 154(b) by 0 days.

(21) Appl. No.: 17/954,523

(22) Filed: Sep. 28, 2022

(51) Int. Cl.

| | |
|---|---|
| ***F21S 6/00*** | (2006.01) |
| ***F21V 17/06*** | (2006.01) |
| ***F21V 3/04*** | (2018.01) |
| ***F21V 1/14*** | (2006.01) |
| ***F21W 121/00*** | (2006.01) |

(52) U.S. Cl.
CPC ..... *F21S 6/002* (2013.01); *F21V 1/143* (2013.01); *F21V 3/049* (2013.01); *F21V 17/06* (2013.01); *F21W 2121/00* (2013.01)

(58) Field of Classification Search
CPC ..... F21S 10/007; F21S 6/002; G03B 23/06; G03B 23/048; G03B 21/208; G03B 21/145; F21V 14/06; F21V 14/065; F21V 17/002; F21V 17/02; F21V 17/104; F21V 17/18; F21V 3/049; F21V 15/01; F21V 33/0028
See application file for complete search history.

(56) References Cited

U.S. PATENT DOCUMENTS

| | | | | | |
|---|---|---|---|---|---|
| 3,164,058 | A * | 1/1965 | Kosowsky | G03B 21/20 | 353/97 |
| 4,232,359 | A * | 11/1980 | Leon | F21V 14/02 | 362/268 |
| 4,313,675 | A * | 2/1982 | Ackeret | G03B 21/06 | 355/44 |
| 4,389,103 | A * | 6/1983 | Kramer | G03B 23/18 | 353/25 |
| 4,466,716 | A * | 8/1984 | Kramer | G03B 23/18 | 353/89 |
| 4,473,280 | A * | 9/1984 | Staar | G03B 31/06 | 353/7 |
| 4,548,486 | A * | 10/1985 | Mosley | G03B 21/64 | 353/95 |

(Continued)

*Primary Examiner* — Jong-Suk (James) Lee
*Assistant Examiner* — James M Endo
(74) *Attorney, Agent, or Firm* — Daniel M. Cohn; Howard M. Colm

(57) ABSTRACT

A projection lamp and a lamp holder include a housing defining a projection port, a lampshade covered on the projection port of the housing, and a projection lamp assembly. Light is emitted from the projection port. The projection lamp assembly includes at least two light sources and a first corrugated sheet. Patterns are provided on the first corrugated sheet. The at least two light sources are configured to emit the light. The light passes through the first corrugated sheet and the lampshade to emit out. Projection brightness of the at least two light sources is great and the first corrugated sheet is replaceable. A projected image is replaced by replacing a pattern-changing gear in tan inserting groove. Light strips are arranged on an outer wall of the projection lamp to create a visual atmosphere effect.

11 Claims, 4 Drawing Sheets

(56) References Cited

U.S. PATENT DOCUMENTS 4,735,499 A * 4/1988 Kiuchi ..... G03B 23/12 353/98
4,756,614 A * 7/1988 Kato ..... G03B 23/105 353/110
5,663,762 A * 9/1997 Nishiyama ..... H04N 1/195 396/428
5,769,684 A * 6/1998 Lou ..... G03B 23/10 446/485
5,791,755 A * 8/1998 Henry ..... G02B 7/006 362/277
5,951,137 A * 9/1999 Bortz ..... G03B 21/16 353/96
6,179,431 B1 * 1/2001 Chien ..... F21L 4/02 362/802
10,042,238 B1 * 8/2018 Zhang ..... G03B 21/003
10,120,270 B1 * 11/2018 Zhang ..... G02B 27/0955
10,125,954 B1 * 11/2018 Zhang ..... F21V 5/048
10,323,829 B1 * 6/2019 Zauhar ..... F21S 8/081
10,830,410 B1 * 11/2020 Wei ..... F21V 23/02
11,041,596 B1 * 6/2021 Zhang ..... F21V 3/049
11,118,753 B1 * 9/2021 Zheng ..... F21V 33/0056
2002/0101571 A1 * 8/2002 Panasewicz ..... F21V 21/0824 353/119
2003/0076682 A1 * 4/2003 Tanaka ..... F21S 10/007 362/345
2006/0066822 A1 * 3/2006 Salvatori ..... G03B 21/142 348/E5.143
2008/0277302 A1 * 11/2008 Yoon ..... A63H 33/22 426/90
2011/0007496 A1 * 1/2011 Chien ..... G01S 3/7864 348/E9.025
2011/0089799 A1 * 4/2011 Goretti ..... B65D 5/4608 312/348.6
2011/0110099 A1 * 5/2011 Quadri ..... F21S 10/007 362/418
2012/0162993 A1 * 6/2012 Cheng ..... F21V 29/767 362/284
2012/0313980 A1 * 12/2012 Kjaer ..... F21S 10/007 353/57
2015/0147932 A1 * 5/2015 Vizcarra ..... G03B 21/145 446/72
2015/0276178 A1 * 10/2015 Chien ..... G03B 21/001 362/95
2015/0365748 A1 * 12/2015 Lee ..... H04R 1/025 381/150
2016/0026073 A1 * 1/2016 Zhang ..... G03B 21/2033 353/101
2016/0313636 A1 * 10/2016 Chien ..... F21V 21/08
2017/0038035 A1 * 2/2017 Liu ..... F21S 8/063
2017/0219176 A1 * 8/2017 Chang ..... A63J 5/025
2019/0129284 A1 * 5/2019 Xi ..... G03B 23/105
2019/0178455 A1 * 6/2019 Jao ..... F21S 10/007
2020/0090535 A1 * 3/2020 Lee ..... G02B 27/18
2021/0164628 A1 * 6/2021 Zheng ..... F21V 5/04
2021/0190295 A1 * 6/2021 Suwa ..... F21V 14/06
2021/0247039 A1 * 8/2021 Zheng ..... F21V 5/04

* cited by examiner

PROJECTION LAMP AND LAMP HOLDER

TECHNICAL FIELD

The present disclosure relates to a technical field of ambient lamps, and in particular to a projection lamp and a lamp holder.

BACKGROUND

A projection lamp generally uses an LED light source to illuminate a projection sheet. Projection characters or projected images are provided on the projection sheet. Light emitted by the LED light source is condensed through a specific lens to illuminate the projection sheet, so the projected characters or the projected images on the projection sheet are projected to a designated position for display, decoration, or lighting.

In the prior art, the projection lamp or a spotlight has poor projection brightness, and a projected image is not clear enough, so that an image effect cannot be optimized. Therefore, it is necessary to propose improvements to the problem.

SUMMARY

In view of above problems, the present disclosure proposes a projection lamp with a replaceable corrugated sheet and a lamp holder to improve projection brightness and make a projected image clear.

To achieve the above object, the present disclosure provides a projection lamp with a replaceable corrugated sheet. The projection lamp comprises a housing defining a projection port, a lampshade covered on the projection port of the housing, and a projection lamp assembly.

Light is emitted from the projection port. The projection lamp assembly comprises at least two light sources and a first corrugated sheet. Patterns are provided on the first corrugated sheet. The at least two light sources are configured to emit the light. The light passes through the first corrugated sheet and the lampshade to emit out.

Furthermore, the at least two light sources are inclined toward the first corrugated sheet.

Furthermore, the projection lamp assembly further comprises a bracket configured to install the first corrugated sheet. The housing defines an inserting groove. The bracket is capable of inserting into the inserting groove and sliding out of the inserting groove.

Furthermore, a pattern-changing gear is arranged on the bracket. The bracket defines a notch. Parts of teeth of the pattern-changing gear are exposed from the notch. The first corrugated sheet is arranged on the pattern-changing gear. A gear component and a motor driving the gear component to rotate are arranged in the housing. After the bracket is inserted into the inserting groove, the parts of the teeth of the pattern-changing gear exposed from the notch are engaged with the gear component.

Furthermore, the bracket comprises a main body inserted into the inserting groove. Two grooves are provided on one end of the bracket exposed to an outside of the housing. The two grooves are configured for fingers to insert into. The two grooves are divided by a pulling plate.

Furthermore, the projection lamp assembly further comprises a second corrugated sheet arranged between the at least two light sources and the first corrugated sheet.

Furthermore, the gear component comprises a plurality of reduction gear sets. The plurality of reduction gear sets comprises a first reduction gear set. A cover body rotated synchronously with the first reduction gear set is arranged on the first reduction gear set. A grating sheet is arranged on the cover body. A laser emitting module is arranged at a lower end of the cover body. Laser emitted by the laser emitting module passes through the grating sheet to project a dynamic projection effect.

Furthermore, light strips are arranged on an outer wall of the housing.

Furthermore, silicone operation buttons are arranged on the housing.

To achieve the above object, the present disclosure further provides a lamp holder. The lamp holder comprises a lamp holder body configured to support the projection lamp with the replaceable corrugated sheet mentioned above.

Compared with the prior art, the present disclosure proposes the projection lamp with the replaceable corrugated sheet. A plurality of light sources provides the light. After the light is concentrated and transmitted, the patterns on the first corrugated sheet is projected to a designated position. In the present disclosure, the projection brightness is increased by the at least two light sources, so that a projected image is clear.

Figure 1:
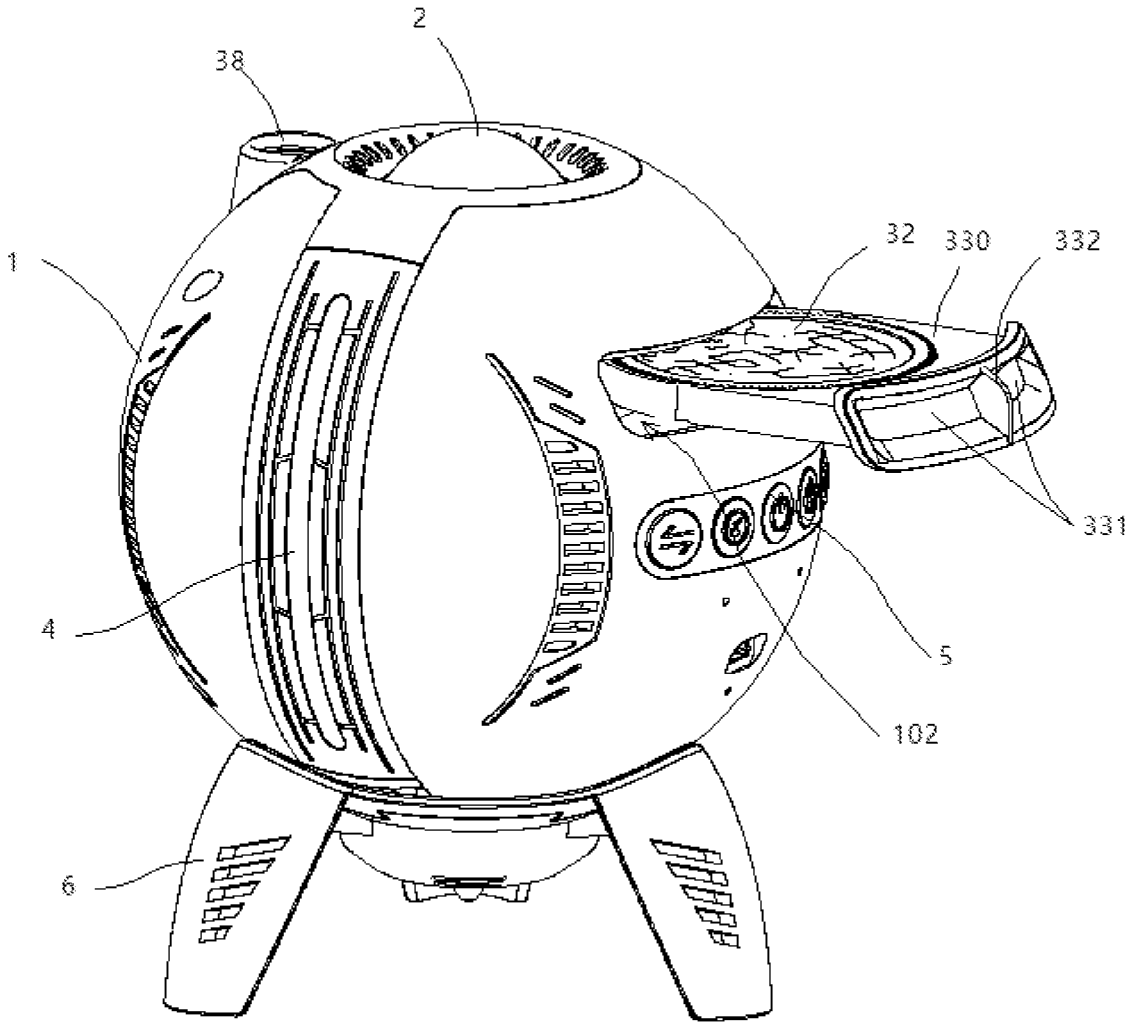
FIG. 1 is a perspective schematic diagram of a projection lamp with a replaceable corrugated sheet of the present disclosure.

1-housing; 101-projection port; 102-inserting groove;
2-lampshade;
3-projection lamp assembly; 30-light source; 31-second corrugated sheet; 32-first corrugated sheet; 33-bracket; 34-pattern-changing gear; 35-gear component; 36-motor; 37-cover body; 38-grating sheet; 39-laser emitting module; 301-condensing cup; 302-cooling fin; 330-main body; 331-groove; 332-pulling plate;
4-light strip; 5-silicone operation button; 6-lamp holder; 7-drive circuit; 8-microcontroller.

DETAILED DESCRIPTION

The present disclosure will be clearly and completely described below in conjunction with the accompanying drawings. Obviously, the described embodiments are only a part of the embodiments of the present disclosure, rather than all of the embodiments. Based on the embodiments of the present disclosure, all other embodiments obtained by those of ordinary skill in the art without creative work shall fall within the protection scope of the present disclosure.

It should be noted that when a component is referred to as being "fixed to" another component, it can be directly fixed on the other component or it may be indirectly fixed on the other component through a mediation component. When a component is considered to be "connected" to another component, it can be directly connected to the other component or it may be indirectly connected to the other component through a mediation component. When a component is considered to be "arranged on" another component, it may be directly arranged on the other component or it may be arranged on the other component through a mediation component. The terms "vertical", "horizontal", "left", "right", and similar expressions are used herein for illustrative purposes only.

Unless otherwise defined, all technical and scientific terms used herein have the same meaning as commonly understood by those skilled in the art of the present disclosure. The terms used in the description of the present disclosure herein are only for the purpose of describing specific embodiments, and are not intended to limit the present disclosure. The term "and/or" used in the present disclosure includes any and all combinations of one or more of the associated listed items.

Technical solutions of the present disclosure will be described below by taking the replaceable first corrugated sheet 32 and a projection lamp with a replaceable corrugated sheet disclosed in the present disclosure as examples.

According to the embodiments disclosed, as shown in FIGS. 1-6, the projection lamp with the replaceable corrugated sheet comprises a housing 1, a lampshade 2, a projection lamp assembly 3, a drive circuit 7, and a microcontroller 8. In the embodiment, the housing 1 has a spherical structure. Of course, a shape and a structure of the housing 1 do not limit the present disclosure. When the housing 1 is the spherical structure, the housing 1 is placed on a lamp holder 6 at any spherical position, so a user is able to freely adjust a projection angle. The lampshade 2 is a convex lens configured to magnify a projected image.

For the structure of the housing 1, the housing 1 defines a projection port 101. Light is emitted from the projection port 101. The lampshade 2 covers on the projection port 101 of the housing 1 to magnify a formed image to be projected. Therefore, the lampshade 2 is the convex lens The projection lamp assembly 3 comprises at least two light sources 30, a first corrugated sheet 32, and a second corrugated sheet 31. The first corrugated sheet 32 rotates during use. The second corrugated sheet 31 is fixed. The at least two light sources 30 emit the light and the patterns on the second corrugated sheet 31 and the patterns on the first corrugated sheet 32 are projected to a surface of an object through the lampshade 2 in a form of light. It is understood that the light emitted by the at least two light sources passes through the second corrugated sheet 31 and the first corrugated sheet 32 and passes through the lampshade 2, so the patterns on the second corrugated sheet 31 and the patterns on the first corrugated sheet 32 are magnified and are projected to a roof, a ceiling, and other positions to form a desired projected image. Of course, it should be noted that the projected image can be changed by replacing the first corrugated sheet 32. In order to achieve different projection effects, different first corrugated sheets 32 are designed to have different patterns such as five-pointed stars, hearts, water ripples, etc. In the embodiment, since the at least two light sources 30 are used, sufficient projection brightness is provided to realize excellent projection effects, so that the projected image is clear.

Arrangement positions of the at least two light sources 30 in the housing 1 will be described in detail below with reference to specific embodiments.

In the above embodiment, the arrangement positions of the at least two light sources 30 in the housing 1 are as follow. A light source installing bracket is arranged in the housing 1, and the light source installing bracket comprises installing positions configured to install the at least two light sources 30. Each of the light sources 30 is installed on a corresponding installing position facing the second corrugated sheet 31. That is, each of the light sources 30 is inclined to form refraction. Compared with one light source, the present disclosure provides at least two light sources, which increases power to increase the projection brightness, so a display effect of the projection lamp in this form is excellent. The power and the effect of the at least two light sources 30 may be same or different, which is not limited thereto. In the embodiment, the number of the light sources 30 is appropriately changed to make up for lack of light quantity, and the light is concentrated on the patterns to obtain best projection effect.

Figure 2:
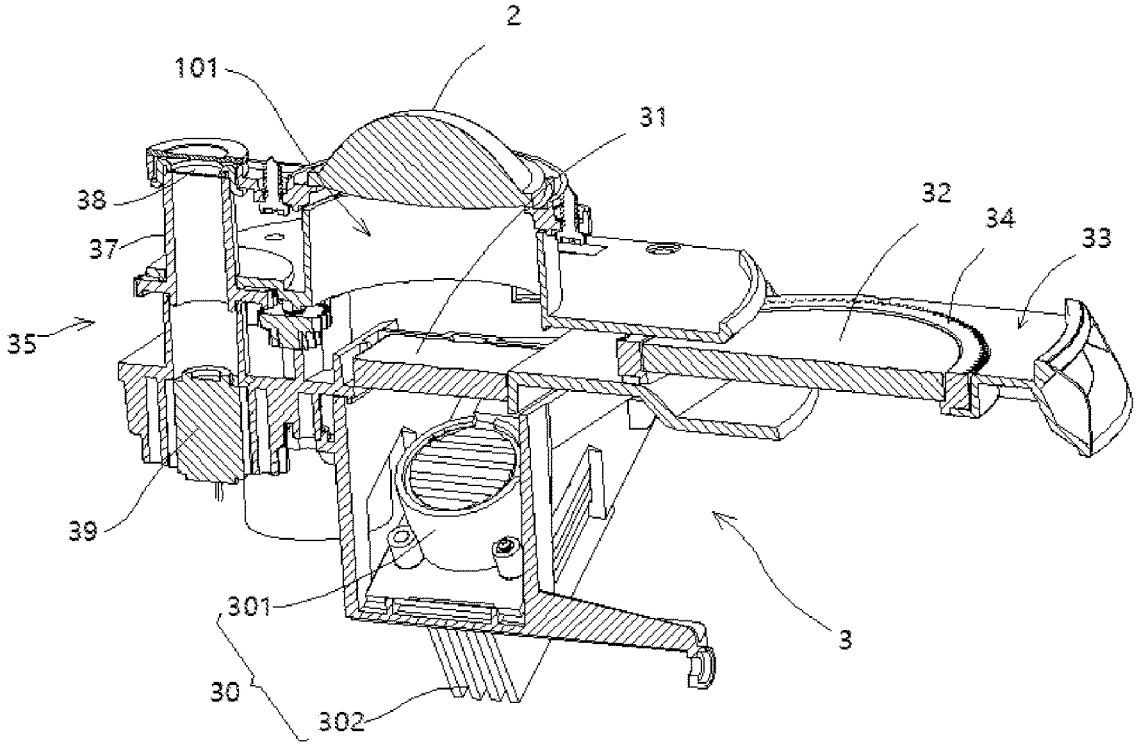
FIG. 2 is a cross-sectional schematic diagram of the projection lamp with the replaceable corrugated sheet of the present disclosure.
Figure 4:
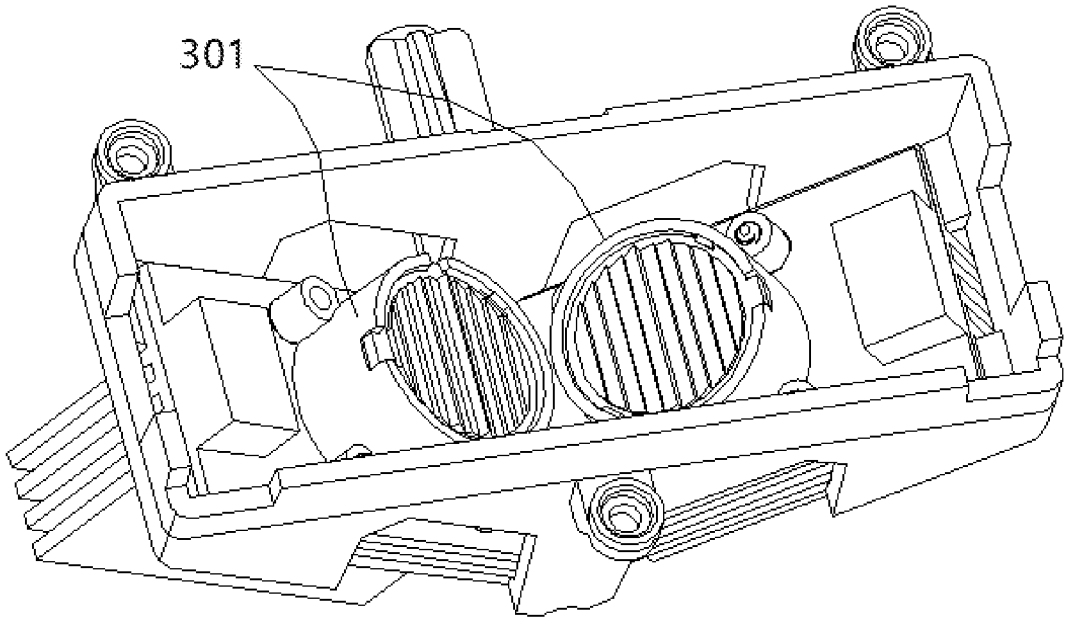
FIG. 4 is a schematic diagram showing positions of a plurality of light sources of the present disclosure.
Figure 5:
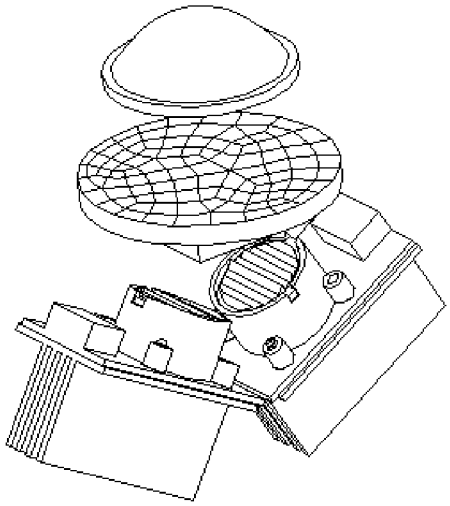
FIG. 5 is a schematic diagram of portions of a projection lamp assembly of the present disclosure.
Figure 6:
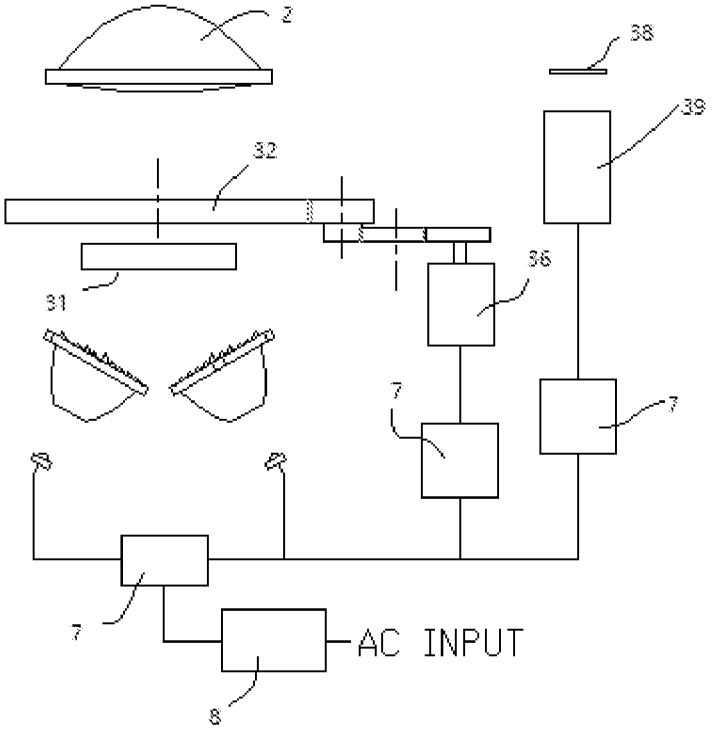
FIG. 6 is a schematic diagram showing a structural principle of the projection lamp with the replaceable corrugated sheet of the present disclosure.

As shown in FIGS. 2, 4, and 5, each of the light sources 30 comprises an LED lamp, a condensing cup 301, and cooling fins 302. The cooling fins 302 are arranged at a bottom portion of a corresponding LED lamp. The cooling fins 302 are configured to dissipate heat to improve service life of each LED lamp. Each condensing cup 301 is a refracting condensing cup arranged at a special angle. As shown in FIG. 6, two light sources are provided in the embodiment. The two condensing cups 301 are symmetrically arranged with a center line of the second corrugated sheet 31 and the first corrugated sheet 32 as an axis of symmetry. Planes of the two condensing cups 301 are respectively arranged at an angle with the center line. The angle ranges from 0-90°, for example, the angle is 45°. In the embodiment, the angle of each of the two condensing cups 301 is not limited, and the two condensing cups 301 may also have a specific angles during processing to project the angled light vertically. In the embodiment, compared with a single lamp cup with vertical incidence on the market, the present disclosure provides the two condensing cups with refraction angles, so that the effect of the projected image of the present disclosure is better.

In order to improve versatility, the first corrugated sheet 32 of the projection lamp in the embodiment is designed to be replaceable. A specific structure of the first corrugated sheet 32 is as shown in FIGS. 1 and 2. The projection lamp assembly further comprises a bracket 33 configured to install the first corrugated sheet 32. The first corrugated sheet 32 is arranged on an installing position of the bracket 33. The housing 1 defines an inserting groove 102 on an outer wall of the housing. The bracket 33 is capable of inserting into the inserting groove 102 and sliding out of the inserting groove 102. When the patterns on the first corrugated sheet 32 need to be changed, the bracket 33 is directly taken out from the inserting groove, the first corrugated sheet arranged on the bracket 33 is replaced with a different first corrugated sheet 32, and then the bracket 33 is inserted into the inserting groove 102.

In some optional embodiment, in order to improve an appearance of the projection lamp, after the bracket 33 is inserted into the inserting groove 102, the bracket 33 seals the inserting groove and a portion of the bracket 3 exposed to an outside and the outer wall of the housing 1 may from a complete sphere, which make it hard to take out the bracket 33. In order to facilitate the user to take out the bracket 33, the bracket 33 is specially designed. As shown in FIG. 1, the bracket 33 comprises a main body 330 inserted into the inserting groove 102. Two grooves 331 are provided on one end of the bracket 33 exposed to the outside of the housing 1. The two grooves 331 are configured for fingers to insert into. The two grooves 331 are divided by a pulling plate 332. Therefore, the bracket 33 is easy to be taken out by the user.

In order to facilitate the user to take out the bracket 33, the bracket 33 is specially arranged.

Figure 3:
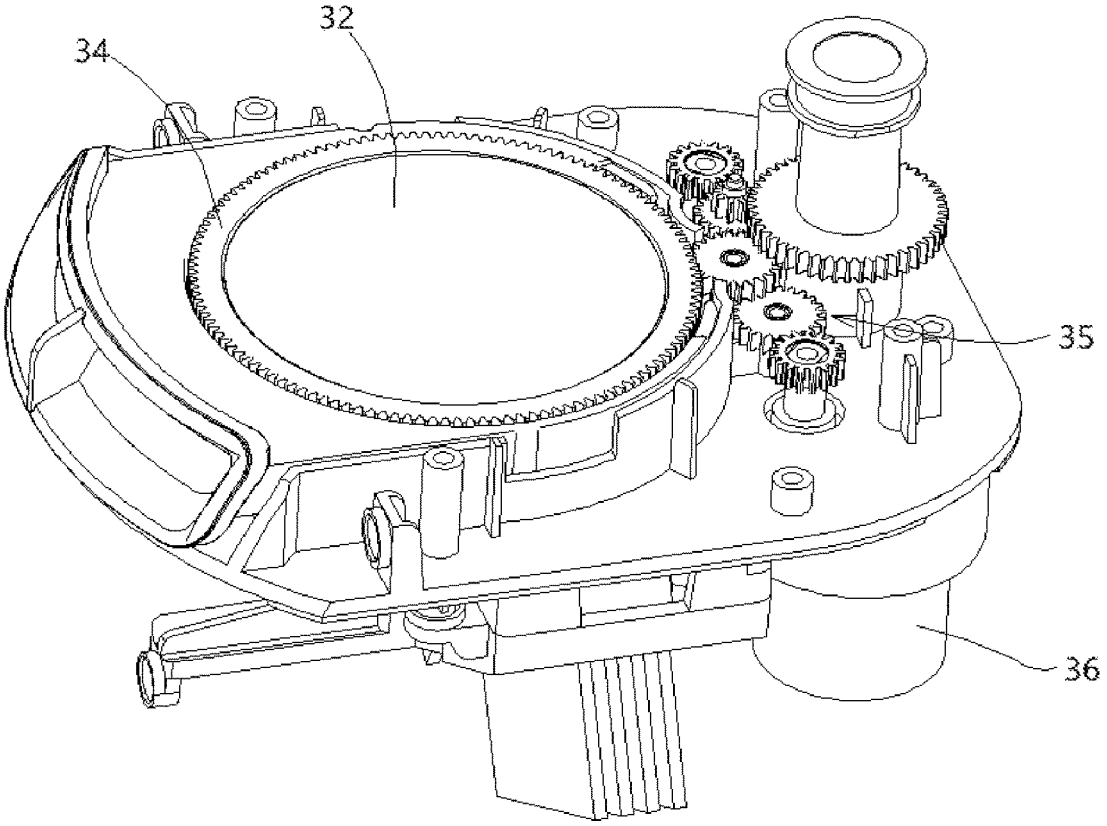
FIG. 3 is a schematic diagram of the replaceable corrugated sheet of the present disclosure.

Moreover, in order to improve a decorative effect, a rotating mechanism driving the first corrugated sheet 323 to rotate is provided. Specifically, as shown in FIG. 3, a pattern-changing gear 34 is arranged on the bracket 33. The bracket defines a notch. Parts of teeth of the pattern-changing gear 34 are exposed from the notch. The first corrugated sheet 32 is integrated with the pattern-changing gear 34 or the first corrugated sheet 32 is arranged on the pattern-changing gear 34. when replacing the patterns on the first corrugated sheet 32, the user is able to replace the first corrugated sheet 32 only, or the user is able to replace the first corrugated sheet 32 and the pattern-changing gear 34 at the same time. A gear component 35 and a motor 36 driving the gear component 35 to rotate are arranged in the housing 1. After the bracket 33 is inserted into the inserting groove 102, the parts of the teeth of the pattern-changing gear 34 exposed from the notch are engaged with the gear component 35.

Under an activation of the motor 36, the pattern-changing gear 34 is driven to rotate, and then the pattern-changing gear 34 drives the first corrugated sheet 32 arranged on the pattern-changing gear 34 to rotate, thereby forming the dynamic projected image.

As an optional solution of the embodiment, the above-mentioned transmission mode achieves an effect of ultra-low-speed rotation of the projected image through cooperation of a low-speed motor and a four-stage transmission teeth.

In order to further improve the decorative effect, as shown in FIG. 2, the gear component 35 comprises a plurality of reduction gear sets. The plurality of reduction gear sets comprises a first reduction gear set. A cover body 37 rotated synchronously with the first reduction gear set is arranged on the first reduction gear set. A grating sheet 38 is arranged on the cover body 37. A laser emitting module 39 is arranged at a lower end of the cover body 37. Laser emitted by the laser emitting module 39 passes through the grating sheet 38 to project a dynamic projection effect. The laser emitting module 39 emits the laser and the laser passes through the grating sheet 38 to generate projected stars and projected dots. Under action of the first reduction gear set, the projected stars and the projected dots rotate synchronously and cooperates with the patterns on the second corrugated sheet 31 and the patterns on the first corrugated sheet 32 to form the desired projected image.

In addition, a TYPE-C interface is arranged on a front side of the housing 1. Light strips 4 are arranged on the outer wall of the housing 1 to provide a visual atmosphere effect. The light straps 4 have different scene modes which are controlled by the user. In the present disclosure, the light straps 4 are evenly arranged on the outer wall of the housing 1. Silicone operation buttons 5 are arranged on the housing 1 for controlling the projection lamp.

As shown in FIG. 1, the present disclosure further provides a lamp holder 6. The lamp holder 6 comprises a lamp holder body configured to support the projection lamp with the replaceable corrugated sheet mentioned above.

Those skilled in the art can easily implement the present disclosure by reading and understanding the above-mentioned specific embodiments. However, it should be understood that the present disclosure is not limited to the specific embodiments. On basis of the disclosed embodiments, those skilled in the art can arbitrarily combine different technical features to realize different technical solutions, and the technical solutions can also be combined with different forms of additional functions to form other technical solutions. Accordingly, the protection scope of the present disclosure is limited only by the scope of appended claims.

The above specification uses specific embodiments to illustrate the present disclosure, which is only used to help understand the present disclosure, and is not intended to limit the present disclosure. For those skilled in the art to which the present disclosure belongs, according to the idea of the present disclosure, some simple deductions, deformations or substitutions can also be made.

What is claimed is:

1. A projection lamp, comprising:

a housing defining a projection port;

a lampshade covered on the projection port of the housing; and a projection lamp assembly;

wherein light is emitted from the projection port; the projection lamp assembly comprises at least two light sources and a first corrugated sheet; patterns are provided on the first corrugated sheet; the at least two light sources are configured to emit the light; the light passes through the first corrugated sheet and the lampshade to emit out, each of the light sources comprises an LED lamp and a condensing cup, and wherein each condensing cup is a refracting condensing cup with refraction angles at a special angle;

wherein the projection lamp assembly further comprises a bracket configured to install the first corrugated sheet; the housing defines an inserting groove; the bracket is capable of inserting into the inserting groove and sliding out of the inserting groove along a horizontal direction;

wherein a pattern-changing gear is arranged on the bracket; the bracket defines a notch; parts of teeth of the pattern-changing gear are exposed from the notch; the first corrugated sheet is arranged on the pattern-changing gear; a gear component and a motor driving the gear component to rotate are arranged in the housing; after the bracket is inserted into the inserting groove, the parts of the teeth of the pattern-changing gear exposed from the notch are engaged with the gear component;

wherein the gear component comprises a plurality of reduction gear sets, the plurality of reduction gear sets comprises a first reduction gear set; a cover body rotated synchronously with the first reduction gear set is arranged on the first reduction gear set; a grating sheet is arranged on the cover body; a laser emitting module is arranged at a lower end of the cover body; laser emitted by the laser emitting module passes through the grating sheet to project a dynamic projection effect;

wherein the motor drives the first corrugated sheet on the pattern-changing gear and the grating sheet on the cover body to rotated synchronously by the reduction gear sets.

2. The projection lamp according to claim 1, wherein the at least two light sources are inclined toward the first corrugated sheet.

3. The projection lamp according to claim 1, wherein the bracket comprises a main body inserted into the inserting groove; two grooves are provided on one end of the bracket exposed to an outside of the housing; the two grooves are configured for fingers to insert into; the two grooves are divided by a pulling plate integrally formed with the bracket.

4. The projection lamp according to claim 1, wherein the projection lamp assembly further comprises a second corrugated sheet arranged between the at least two light sources and the first corrugated sheet.

5. The projection lamp according to claim 4, wherein the two condensing cups are symmetrically arranged with a center line of the second corrugated sheet as an axis of symmetry.

6. The projection lamp according to claim 1, wherein light strips are arranged on an outer wall of the housing.

7. The projection lamp according to claim 1, wherein silicone operation buttons are arranged on the housing.

8. The projection lamp according to claim 1, wherein the first corrugated sheet is configured for inserting into the inserting groove and sliding out of the inserting groove along the horizontal direction, and the first corrugated sheet is configured for rotating with the pattern-changing gear along the horizontal direction.

9. The projection lamp according to claim 1, wherein the first corrugated sheet is designed to have patterns with texture.

10. A lamp holder, comprising: a lamp holder body configured to support the projection lamp according to claim 1.

11. The projection lamp according to claim 5, wherein planes of the two condensing cups are respectively arranged at an angle with the center line, the angle ranges from 0°-90°.

* * * * *